US005906302A

United States Patent [19]

Spergel

[11] Patent Number: 5,906,302

[45] Date of Patent: May 25, 1999

[54] SCUBA TANK MOUNTING MECHANISM

[76] Inventor: Michael J. Spergel, 210 Chance Dr., Oceanside, N.Y. 11572

[21] Appl. No.: 08/807,343

[22] Filed: Feb. 28, 1997

[51] Int. Cl.[6] ..... A45F 3/14

[52] U.S. Cl. ..... 224/250; 224/934; 248/213.2; 248/313

[58] Field of Search ..... 224/934, 250, 224/271, 272; 128/205.22, 201.27, 201.29; 405/186, 187; 248/154, 230.8, 313, 213.2

[56] References Cited

U.S. PATENT DOCUMENTS

| | | | |
|---|---|---|---|
| 3,191,828 | 6/1965 | Senne | 224/934 |
| 4,889,306 | 12/1989 | Boucher | 224/934 |
| 4,949,889 | 8/1990 | Carson | 224/269 |
| 5,271,387 | 12/1993 | Murray | 224/934 |
| 5,390,886 | 2/1995 | Lawner et al. | 248/224.3 |
| 5,579,967 | 12/1996 | Berg | 224/250 |

OTHER PUBLICATIONS

Photographs of device sold by Tiger Gear no earlier than Jan. 1997.

*Primary Examiner*—Linda J. Sholl

*Attorney, Agent, or Firm*—Davidson, Davidson & Kappel, LLC

[57] ABSTRACT

A mounting mechanism is provided for mounting a second SCUBA tank (e.g. a pony tank) to a first SCUBA tank (e.g. a main SCUBA tank). The mounting mechanism includes a bracket having a first curved outer surface for engaging the first SCUBA tank, having a second curved outer surface for engaging a second SCUBA tank, and having a connecting portion connecting the first curved outer surface to the second curved outer surface, a passage being formed in the connecting portion. A first clamp extends through the passage in the connecting portion and secures the second SCUBA tank to the second curved outer surface. A second clamp, for example the existing BCD strap of a main SCUBA tank, extends through the passage in the connecting portion and secures the second SCUBA tank to the first curved outer surface.

27 Claims, 4 Drawing Sheets

FIG. 1
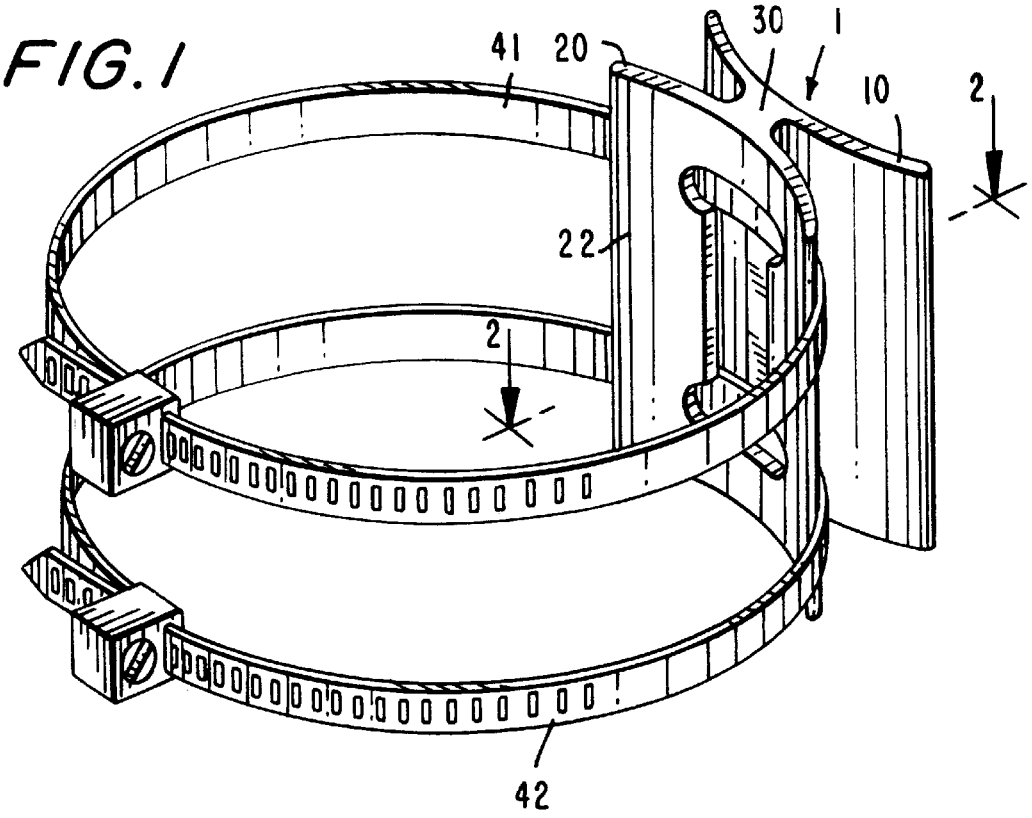
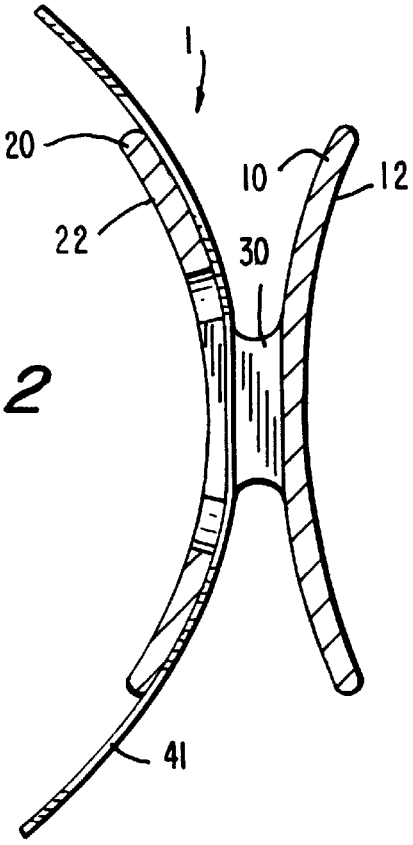
FIG. 2
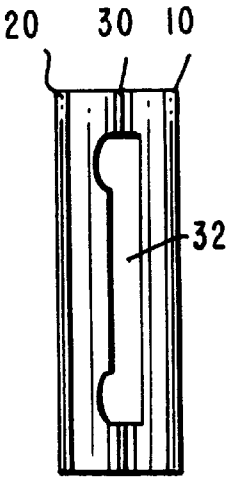
FIG. 3

SCUBA TANK MOUNTING MECHANISM

FIELD OF THE INVENTION

The present invention relates to the field of SCUBA (self contained underwater breathing apparatus) diving equipment, and particularly to the field of mounting mechanisms for mounting one SCUBA tank to another scuba tank or to other SCUBA accessories.

BACKGROUND OF THE INVENTION

Mounting systems are known for securing a pony tank to a main SCUBA tank. U.S. Pat. No. 5,579,967 to Berg purports to disclose a pony tank mounting system which includes a joining bracket, a pair of hose clamps for securing the pony tank to the bracket, and a strap for suspending the joining bracket with pony tank from a valve on the main SCUBA tank.

SUMMARY OF THE INVENTION

In accordance with the present invention, a mounting mechanism is provided for mounting a second SCUBA tank (e.g., a pony tank) to a first SCUBA tank (e.g., a main SCUBA tank). The mounting mechanism includes a bracket having a first curved outer surface for engaging the first SCUBA tank, and having a second curved outer surface for engaging the second SCUBA tank. The first and second curved outer surfaces are spaced apart by a connecting portion which connects the first curved outer surface to the second curved outer surface. A passage is formed in the connecting portion and a first clamp extends through the passage in the connecting portion to secure the second SCUBA tank to the second curved outer surface. A second clamp also extends through the passage to secure the first SCUBA tank to the first curved outer surface. Preferably, the first curved outer surface has a first concave shape which substantially matches a circumferential outer surface of the first SCUBA tank, and the second curved outer surface has a second concave shape which substantially matches a circumferential outer surface of the second SCUBA tank. With this construction, the second SCUBA tank is firmly secured to the first SCUBA tank. Moreover, by substantially matching the shape of the first and second curved outer surfaces to the shape of the first and second SCUBA tanks, respectively, a particularly secure fit is achieved.

In accordance with a further embodiment of the present invention, the second clamp is an existing strap of a Buoyancy Compensation Device (BCD strap). As one of ordinary skill in the art will appreciate, a BCD strap is conventionally used to secure a main SCUBA tank to a BCD. Therefore, the mounting system in accordance with the present invention can utilize the BCD strap to secure the second SCUBA tank to the first SCUBA tank, eliminating the need for a separate strap.

BRIEF DESCRIPTION OF THE DRAWINGS

FIG. 1 shows a side view of a bracket in accordance with an embodiment of the present invention including hose clamps.

FIG. 2 shows a top cross-sectional view of the bracket of FIG. 1 including hose clamps.

FIG. 3 shows the connecting portion and passage of FIGS. 1 and 2 in more detail.

DETAILED DESCRIPTION OF THE INVENTION

Figure 4:
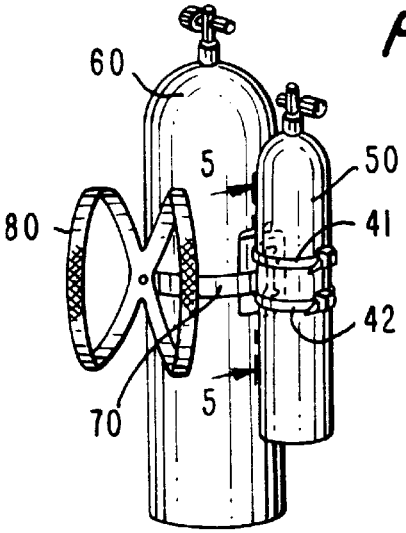
FIG. 4 shows the bracket of FIGS. 1 through 3 securing a pony tank to a main SCUBA tank using hose clamps and a BCD strap.

In order to remain under water for an extended period of time, divers typically utilize a main SCUBA tank which is secured to a supporting vest by a BCD strap. A mouthpiece is connected to the main SCUBA tank by a connecting tube to provide air to the diver. In order to protect the diver in the event of main SCUBA tank system failure, it is known to employ a pony tank, which is generally a smaller tank that is secured to the main SCUBA tank. In accordance with the present invention, a mounting system is provided that may be used to secure the pony tank to the main SCUBA tank.

FIGS. 1, 2, and 3 show a bracket 1 in accordance with an embodiment of the present invention. The bracket 1 has a first concave outer portion 10 and a second concave outer portion 20, joined by a connecting portion 30. The outer surface 12 of the first concave outer portion 10 is a curved surface with a shape that substantially matches the shape of an outer circumferential surface of a main SCUBA tank. The outer surface 22 of the second concave outer portion 20 is a curved surface with a shape that substantially matches the shape of an outer circumferential surface of a pony tank. A passage 32 is formed in the connecting portion 30. A hole 35 may be formed in one of the concave portions (illustrated as portion 20 in FIG. 1) for ease of manufacture.

Figure 7:
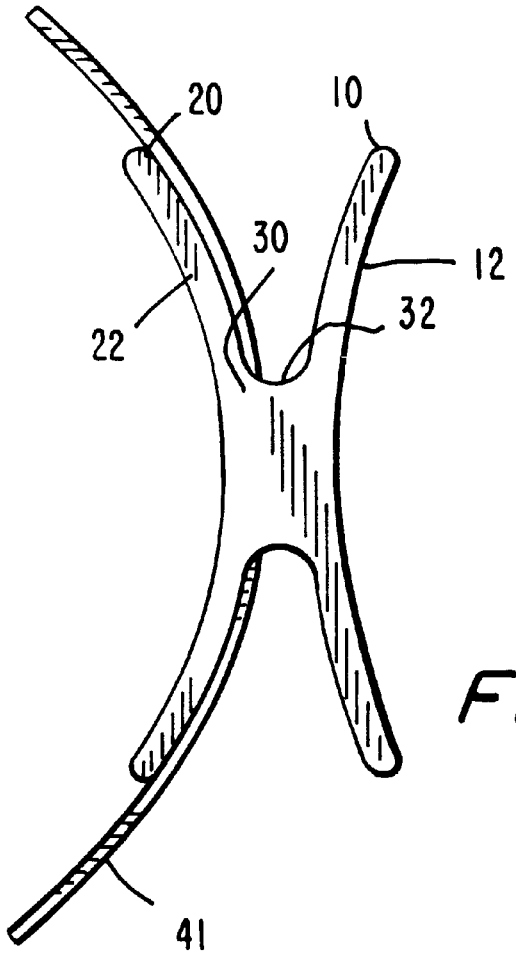
FIG. 7 shows a top view of a bracket in accordance with another embodiment of the present invention having first and second open-polygonal-concave portions.

The shape of the respective outer surfaces 12, 22 need not match the shapes of their respective tanks, but should be close enough in shape to provide a secure fit. As an illustration, I have found that a radius of 3.63 inches for the outer surface 12 provides a particularly secure fit for most main SCUBA tanks (which generally have a diameter of 7½ to 8½ inches) and that a radius of 2.44 inches for the outer surface 22 provides a particularly secure fit for most pony tanks (which generally have a diameter of 3½ to 5 inches). Moreover, the concave outer portions 10, 20 and their respective surfaces 12, 22 need not be circumferential (or even curved). For example, the surfaces 12, 22 could be formed as an open (e.g. partial) polygon as illustrated in FIG. 7. However, a superior fit is achieved in accordance with the preferred embodiment of the present invention by providing circumferential outer surfaces 12, 22 on the concave outer portions 10, 20.

Figure 6:
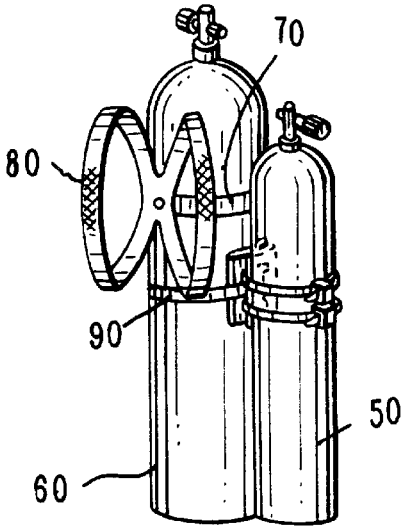
FIG. 6 shows a more detailed view of the bracket of FIGS. 4 and 5.

FIGS. 4 and 6 show a pony tank 50 secured to a main SCUBA tank 60 by the bracket 1 of FIGS. 1 and 2. A pair of clamps 41, 42 extend through the passage 32 and around the pony tank to secure the pony tank to the bracket 1. The clamps 41, 42 are preferably hose clamps, but may be of any known construction. For example, the clamps could be comprised of metal, rubber or cloth straps. A buoyancy compensating device 80 (BCD) with a BCD strap 70 secured thereto is shown schematically for ease of illustration. The BCD strap 70 extends from the BCD 80 around the main SCUBA tank 60 and through the passage 32. In this manner, the BCD strap 70 secures the main SCUBA tank 60 to the BCD 80 and the bracket 1 (with the pony tank 50 secured thereto) to the main SCUBA tank 60. In this manner, the pony tank 50 is secured to the main SCUBA tank 60 utilizing the existing BCD strap 70. Moreover, by substantially matching the shape of the first and second curved outer surfaces to the shape of the first and second SCUBA tanks, respectively, a particularly secure fit is achieved.

Figure 5:
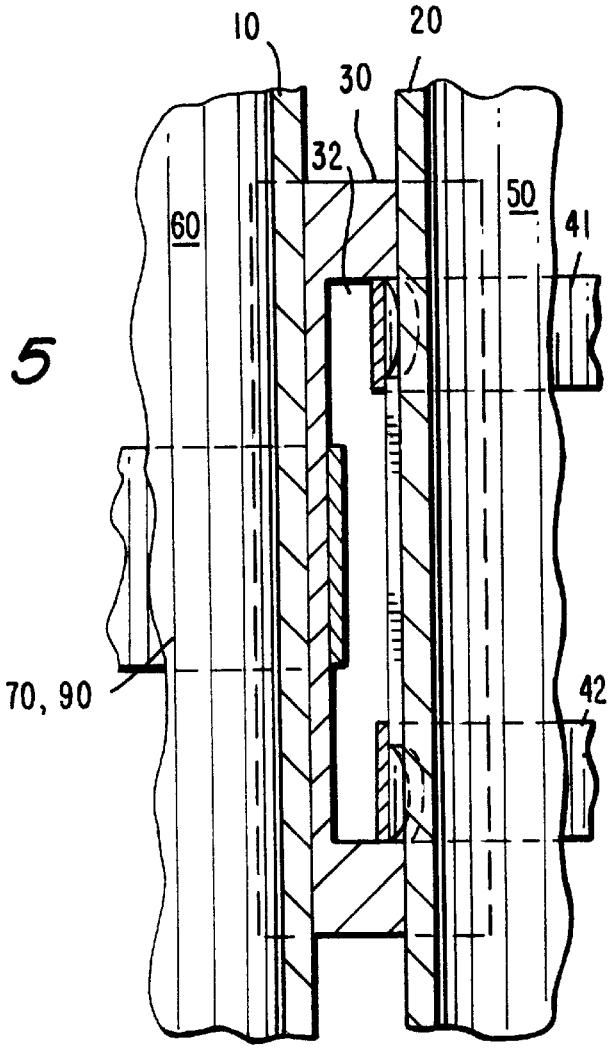
FIG. 5 shows the bracket of FIGS. 1 through 3 securing a pony tank to a main SCUBA tank using hose clamps and a cam strap.

FIGS. 5 and 6 shows an alternative system for securing the pony tank 50 to the main SCUBA tank 60. As in FIG. 4, the clamps 41, 42 extend through the passage 32 and around the pony tank to secure the pony tank to the bracket 1. However, in accordance with the embodiment of FIG. 5, a separate cam strap 90 extends around the main SCUBA tank 60 and through the passage 32 to secure the bracket 1 (with the pony tank 50 secured thereto) to the main SCUBA tank 60. The main SCUBA tank 60 (with the pony tank 50 and bracket 1 secured thereto) is secured to the BCD 80 (or other supporting vest) by the BCD strap 70 (or other known means). The strap 90 is preferably a cam strap, but could alternately be any other suitable clamp or strap such as a hose clamp or a metal, cloth or rubber strap.

It should be noted that the mounting system in accordance with the present invention need not be used to mount one SCUBA tank to the other. For example, it could be used to mount other cylindrical SCUBA accessories (such as lighting systems or diver propulsion devices) to a main SCUBA tank or to a pony tank.

Figure 9:
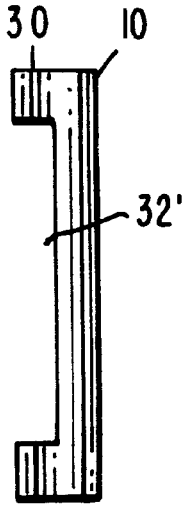
FIG. 9 shows the connecting portion and passage of FIG. 8 in more detail.
Figure 8:
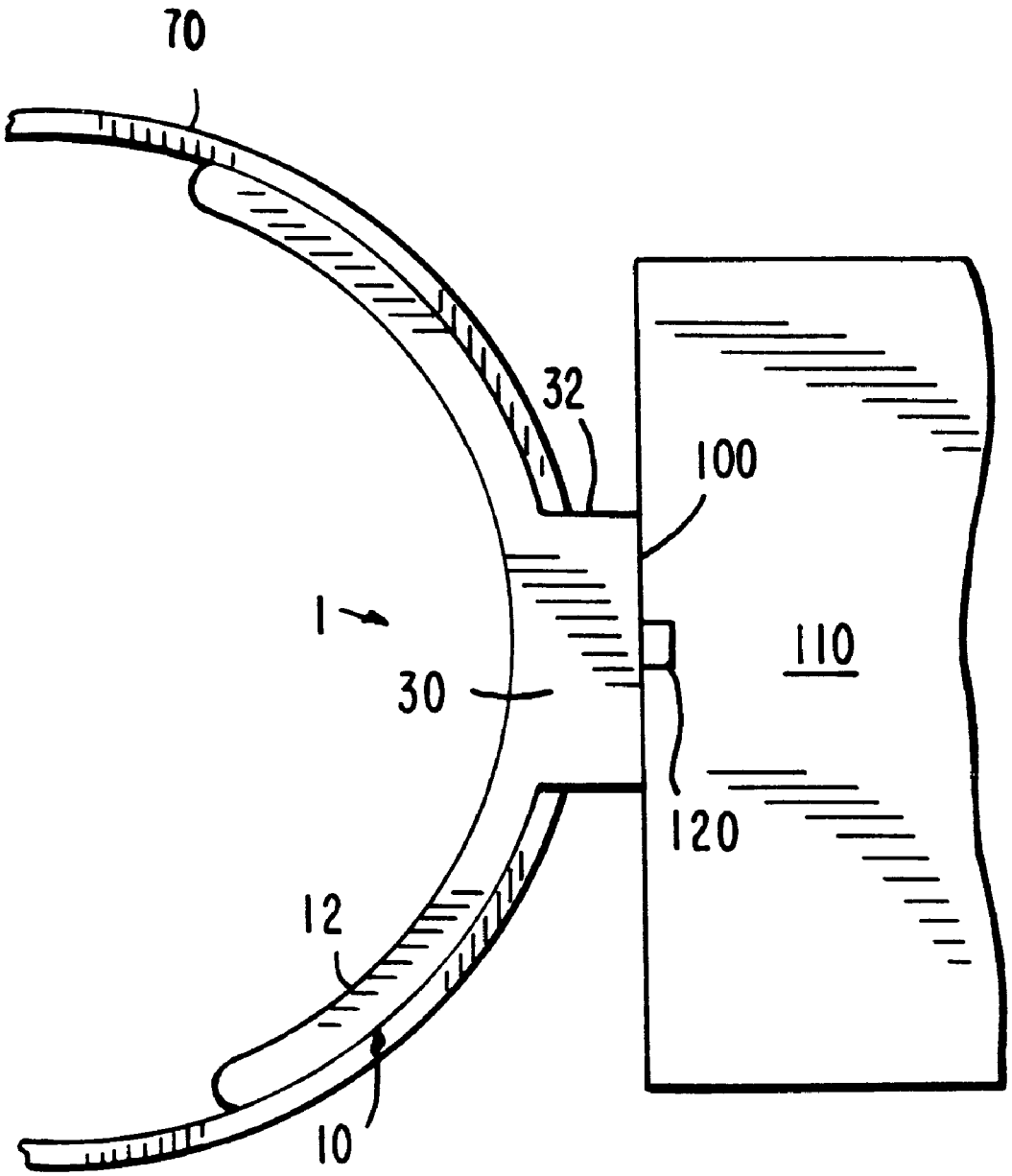
FIG. 8 shows a top view of a bracket in accordance with a further embodiment of the present invention for securing a SCUBA accessory having a planar mounting surface to a SCUBA tank.

In accordance with another embodiment of the present invention, a mounting device is provided for mounting a SCUBA accessory having a planar (or flat) mounting surface to a SCUBA tank. In accordance with this embodiment, the second concave portion 20 is eliminated, and the passage 32 of FIGS. 1 and 2 is replaced with an open passage 32' as shown in FIGS. 8 and 9. A scuba accessory 110 having a planar mounting surface 100 (for example, a re-breather) is fastened to the bracket 1 via fasteners such as screws 120. Once the planar surface 100 is secured to the bracket, the open side the passage 32' is covered by the planar surface 100, and the bracket (with the scuba accessory 110 attached thereto) can be secured to a SCUBA tank (or other cylindrical SCUBA accessories) by clamps (such as hose clamps, cam straps, or BCD straps).

The embodiments described above are not meant to be exclusive. Many other variations of the present invention would be obvious to those skilled in the art, and are contemplated to be within the scope of the appended claims.

What is claimed is:

1. A mounting mechanism for mounting a second SCUBA tank to a first SCUBA tank, the mounting mechanism comprising:

a bracket having a first curved outer surface and a second curved outer surface, the first curved outer surface being closest to the second curved outer surface at a mid-point along the first curved outer surface and a midpoint along the second curved outer surface, the first curved outer surface for engaging the first SCUBA tank, the second curved outer surface for engaging a second SCUBA tank, the bracket having a connecting portion connecting the first curved outer surface to the second curved outer surface, a passage being formed in the connecting portion, the passage having top, bottom, and lateral walls;

a first clamp having a strap portion, the strap portion extending through the passage in the connecting portion, the first clamp for securing the second SCUBA tank to the second curved outer surface, the passage for receiving a strap portion of a second clamp to secure the first SCUBA tank to the first curved outer surface.

2. The mounting mechanism according to claim 1, wherein the first curved outer surface has a first concave shape which substantially matches a circumferential outer surface of the first SCUBA tank, and wherein the second curved outer surface has a second concave shape which substantially matches a circumferential outer surface of the second SCUBA tank.

3. The mounting mechanism according to claim 1, further comprising a third clamp extending through the passage in the connecting portion, the third clamp for securing the second SCUBA tank to the second curved outer surface.

4. The mounting mechanism according to claim 3, wherein the first and third clamps are hose clamps.

5. The mounting mechanism according to claim 1, further comprising a BCD strap for securing the first SCUBA tank to a supporting vest.

6. The mounting mechanism according to claim 5, wherein mounting mechanism further includes the second clamp.

7. The mounting mechanism according to claim 6, wherein the second clamp is a cam strap.

8. The mounting mechanism according to claim 5, wherein the BCD strap is the second clamp.

9. The mounting mechanism according to claim 1, wherein mounting mechanism further includes the second clamp.

10. The mounting mechanism according to claim 9, wherein the second clamp is a cam strap.

11. The mounting mechanism according to claim 10, wherein the first SCUBA tank is a main scuba tank and the second SCUBA tank is a pony tank.

12. The mounting mechanism according to claim 1, wherein the first curved outer surface, the second curved outer surface, and the connecting portion are formed from an integral piece of material.

13. The mounting mechanism of claim 1, wherein a hole is formed in one of the first and second curved outer surfaces and through a corresponding one of the lateral walls.

14. A mounting mechanism for mounting a pony tank to a main SCUBA tank using an existing strap of the main SCUBA tank, the mounting mechanism comprising:

a bracket having a first curved outer surface and a second curved outer surface, the first curved outer surface being closest to the second curved outer surface at a mid-point along the first curved outer surface and a midpoint along the second curved outer surface, the first curved outer surface for engaging a main SCUBA tank, the second curved outer surface for engaging a pony tank, the bracket having a connecting portion connecting the first curved outer surface to the second curved outer surface, a passage being formed in the connecting portion, the passage having top, bottom, and lateral walls;

a first clamp having a strap portion, the strap portion extending through the passage in the connecting portion, the first clamp for securing the pony tank to the second curved outer surface, the passage for receiving a strap to secure the main SCUBA tank to the first curved outer surface.

15. The mounting mechanism according to claim 14, wherein the first curved outer surface has a first concave shape which substantially matches a circumferential outer surface of the main SCUBA tank, and wherein the second curved outer surface has a second concave shape which substantially matches a circumferential outer surface of the pony tank.

16. The mounting mechanism according to claim 14, further comprising a second clamp extending through the passage in the connecting portion, the second clamp for securing the pony tank to the second curved outer surface.

17. The mounting mechanism according to claim 16, wherein the first and second clamps are hose clamps.

18. The mounting mechanism according to claim 14, wherein the first curved outer surface, the second curved outer surface, and the connecting portion are formed from an integral piece of material.

19. A bracket for mounting a first SCUBA tank to a second SCUBA tank, the bracket having a first curved outer surface and a second curved outer surface, the first curved outer surface being closest to the second curved outer surface at a mid-point along the first curved outer surface and a midpoint along the second curved outer surface, the first curved outer surface for engaging the first SCUBA tank, the second curved outer surface for engaging a second SCUBA tank, the bracket having a connecting portion connecting the first curved outer surface to the second curved outer surface, a passage being formed in the connecting portion, the passage having top, bottom, and lateral walls, the passage for receiving a first strap to secure the second SCUBA tank to the second curved outer surface, the passage for receiving a second strap to secure the first SCUBA tank to the first curved outer surface.

20. The mounting mechanism according to claim 19, wherein the first curved outer surface has a first concave shape which substantially matches a circumferential outer surface of the first SCUBA tank, and wherein the second curved outer surface has a second concave shape which substantially matches a circumferential outer surface of the second SCUBA tank.

21. The bracket according to claim 19, wherein the first curved outer surface, the second curved outer surface, and the connecting portion are formed from an integral piece of material.

22. A mounting mechanism for mounting a cylindrical SCUBA accessory to a SCUBA tank, the mounting mechanism comprising:

a bracket having a first concave portion and a second concave portion, the first concave portion being closest to the second concave portion at a mid-point along the first concave portion and a midpoint along the second concave portion, the first concave portion for engaging a SCUBA tank, the second concave portion for engaging a cylindrical SCUBA accessory, the bracket having a connecting portion connecting the first concave portion to the second concave portion, a passage being formed in the connecting portion, the passage having top, bottom, and lateral walls;

a first clamp having a strap portion, the strap portion extending through the passage in the connecting portion, the first clamp for securing the cylindrical SCUBA accessory to the second concave portion, the passage for receiving a strap portion of a second clamp to secure the SCUBA tank to the first concave portion.

23. The mounting mechanism according to claim 22, wherein the first concave portion has a first curved outer surface for engaging the SCUBA tank, and wherein the second concave portion has a second curved outer surface for engaging the cylindrical SCUBA accessory.

24. The mounting mechanism according to claim 22, wherein the first and second concave portions are formed in a shape of an open polygon.

25. The mounting mechanism according to claim 22, wherein the cylindrical SCUBA accessory is a pony tank.

26. The mounting mechanism according to claim 22, wherein the first concave portion, the second concave portion, and the connecting portion are formed from an integral piece of material.

27. The mounting mechanism of claim 22, wherein a hole is formed in one of the first and second concave portions, and wherein the first and second concave portions form the lateral walls.

* * * * *